US008176669B1

(12) United States Patent
Griffin

(10) Patent No.: US 8,176,669 B1
(45) Date of Patent: May 15, 2012

(54) RAIL ACCESSORY MOUNTING APPARATUS FOR WEAPON

(75) Inventor: Todd Griffin, Miami, FL (US)

(73) Assignee: RM Equipment, Inc., Miami, FL (US)

( * ) Notice: Subject to any disclaimer, the term of this patent is extended or adjusted under 35 U.S.C. 154(b) by 0 days.

(21) Appl. No.: 12/353,828

(22) Filed: Jan. 14, 2009

Related U.S. Application Data

(60) Provisional application No. 61/020,891, filed on Jan. 14, 2008, provisional application No. 61/025,579, filed on Feb. 1, 2008, provisional application No. 61/045,010, filed on Apr. 15, 2008.

(51) Int. Cl.
*F41A 23/02* (2006.01)

(52) U.S. Cl. ..... 42/90

(58) Field of Classification Search ..... 42/90, 96, 42/71.01, 105, 85, 124
See application file for complete search history.

(56) References Cited

U.S. PATENT DOCUMENTS

| | | | | | |
|---|---|---|---|---|---|
| 958,989 | A * | 5/1910 | Bennett | 42/124 |
| 2,717,447 | A * | 9/1955 | Leupold | 42/127 |
| 4,733,489 | A | 3/1988 | Kurak | |
| 4,845,871 | A * | 7/1989 | Swan | 42/127 |
| D322,834 | S * | 12/1991 | Lawlor | D22/110 |
| 5,758,448 | A * | 6/1998 | Thummel | 42/114 |
| 5,826,363 | A | 10/1998 | Olson | |
| 5,930,935 | A | 8/1999 | Griffin | |
| 5,941,489 | A * | 8/1999 | Fanelli et al. | 248/298.1 |
| 6,134,823 | A | 10/2000 | Griffin | |
| 6,792,711 | B2 | 9/2004 | Battaglia | |
| 7,111,424 | B1 | 9/2006 | Moody et al. | |
| 7,275,344 | B2 * | 10/2007 | Woodmansee et al. | 42/146 |
| 7,395,627 | B2 * | 7/2008 | La France et al. | 42/114 |
| 7,454,858 | B2 * | 11/2008 | Griffin | 42/71.01 |
| 7,568,304 | B1 * | 8/2009 | Moody et al. | 42/72 |
| 7,571,562 | B2 * | 8/2009 | Sutherby | 42/90 |
| 7,703,231 | B2 * | 4/2010 | Wei | 42/90 |
| 2003/0106252 | A1 * | 6/2003 | Hines | 42/90 |
| 2004/0000083 | A1 * | 1/2004 | Grant, Jr. | 42/112 |
| 2005/0217161 | A1 * | 10/2005 | Haugen et al. | 42/124 |
| 2005/0252060 | A1 * | 11/2005 | Gonzalez | 42/90 |
| 2006/0191183 | A1 * | 8/2006 | Griffin | 42/72 |
| 2006/0277809 | A1 | 12/2006 | Moody et al. | |
| 2007/0234628 | A1 * | 10/2007 | La France et al. | 42/146 |
| 2007/0266612 | A1 * | 11/2007 | Kim | 42/127 |
| 2007/0271832 | A1 | 11/2007 | Griffin | |

OTHER PUBLICATIONS

Young, Lee W., PCT International Search Report and Written Opinion of the International Searching Authority, PCT Application No. PCT/US09/30981, Sep. 2, 2009.

Carone, Michael, PCT International Preliminary Report on Patentability of the International Preliminary Examining Authority, PCT Application No. PCT/US09/30981, Jun. 2, 2010.

* cited by examiner

*Primary Examiner* — Bret Hayes
*Assistant Examiner* — Reginald Tillman, Jr.
(74) *Attorney, Agent, or Firm* — Nawrocki, Rooney & Sivertson, P.A.

(57) ABSTRACT

A rail accessory mounting apparatus is provided. The apparatus generally comprises actuatable jaw segments and a base from which the jaw segments extend, a collar within which a portion of the base is seated with the jaw segments operatively engageable with a portion of the collar in furtherance being drawn together upon actuation. Moreover, an actuator, progressively advanceable in relation to the base so as to effectuate actuation of the jaw segments is provided, as well as a rail accessory receiving fixture supported at or by the collar, the fixture comprising a segment having a dovetail configuration characterized by a wedge shaped cross section with which a rail accessory device is readily mateable.

30 Claims, 19 Drawing Sheets

RAIL ACCESSORY MOUNTING APPARATUS FOR WEAPON

This is a U.S. national patent application filed under 35 U.S.C. §111(a) claiming priority under 35 U.S.C. §119(e)(1), of several U.S. provisional applications, namely U.S. patent application Ser. Nos. 61/020,891, filed Jan. 14, 2008; 61/025,579, filed Feb. 1, 2008; and, 61/045,010, filed Apr. 15, 2008, each of which incorporated herein by reference in its entirety.

TECHNICAL FIELD

The present invention generally relates to weapons and/or facsimiles thereof, more particularly, to a rail accessory mounting apparatus for use in combination with a weapon or facsimile thereof, more particularly, and by way of non-limiting illustration, to a rail accessory mounting apparatus enabling rail system accessory capability for, among other things, an M203 40 mm grenade launcher.

BACKGROUND OF THE INVENTION

Weapon adaptability has been and remains advantageous. Generalists have sought to add functionality to their weapon. A well known, and well documented example of enhanced functionality, namely, dual functionality, is the M203 40 mm grenade launcher. This single shot launcher was designed as a rifle attachment in order to increase the efficiency with which a soldier could alternate between bullet fire via the "host weapon," and high energy grenade fire which was previously available via use of a dedicated, separate weapon, namely, the M79. Many interface approaches were developed in furtherance of equipping a host weapon with the M203 launcher (e.g., U.S. Pat. Nos. 4,733,489, 5,930,935, and 6,134,823).

In addition to a primary function of propelling a munition, a variety of supplemental or secondary weapon system functions/features are advantageous and well know. For example, enhanced target sighting, target illumination, and weapon support (via shoulder strap, grip, bi-pod, tri-pod, etc.) to name but a few. To facilitate such enhanced functionality for a weapon/host weapon (i.e., the inclusion of add-on devices), an interface solution was sought, and a rail system (i.e., bracket) emerged.

The two most common interface solutions are the Rail Interface System (RIS) and Rail Adapter System (RAS), each of which is essentially a bracket, more particularly an accessory mounting rail, used in connection to small arms/weapons. The rails commonly replace the factory handguards of a host weapon system, e.g., SR-15(AR-15), M-16, or SR-25 weapon systems (see e.g., U.S. Pat. No. 5,826,363), and are placed directly on the receiver of the weapon. Alternately, unaltered or minimally altered host weapon rail arrangements are know, more particularly, those in which rails are added to the host weapon as opposed to substituted for a portion of the barrel handguard or the like (see e.g., U.S. Pat. No. 6,792,711). Either rail style/format functions so as to provide attachment points for a variety of weapon system accessories such as tactical lights and laser sighting modules.

The subject systems have their origins in military standard "MIL-STD-1913 (AR), 3 Feb. 1995" entitled "Dimensioning of Accessory Mounting Rail for Small Arms Weapon," and an update thereto, namely, "MIL-STD-1913 Update Notice 1, 10 Jun. 1999," each of which are incorporated herein by reference. The subject standard established methods of dimensioning accessory mounting rails for small arms weapon systems, and also established uniform accessory mounting rails and requirements that are interchangeable among the different units of the Department of Defense. As the standard was first published by the Picatinny Arsenal of New Jersey, such devices are commonly referred to as "Picatinny rails." The standard, having been adopted by the North Atlantic Treaty Organization (NATO), is also know by that organization's designation, namely, STANAG 2324.

The accessory mounting rail of the MIL-STD-1913 generally comprises a grooved dovetail feature that serves as a mounting platform used to mount (i.e., receive) accessories such as, for example, laser pointers, fire control devices, night vision devices, grenade launchers, optics, thermal weapon sights, etc. The dovetail or dovetail configuration of the rail is characterized by a wedge shaped cross section. Grooves of the grooved dovetail are recoil grooves which are intended to prevent fore and aft movement of a rail mounted accessory.

The RIS and RAS units generally comprise two major components, namely, a top component consisting of top, left, and right quadrants, and a bottom component consisting of a bottom quadrant. Each quadrant contains a MIL-STD-1913 rail that can be used to attach a variety of weapon accessories. Differences between the units occur in the way that they attach to the handguard cap and delta ring/barrel nut; how the units are numbered; and, the types of barrels that they can be used with.

As previously noted, known rail systems are generally, but not necessarily installed in place of the weapon handguard (i.e., substituted therefore), and are intended to provide a universal structure (i.e., a rail) for mating attachment (i.e., receipt) of accessories, e.g., a flashlight, a thermal scope, a laser, etc., to the rifle at 3, 6, 9, and 12-o'clock positions about the weapon barrel. Known systems incorporate different rail lengths and integration techniques for attachment to the weapon. Some units consist of a two-piece assembly, namely, a first portion providing rails at the 3, 9, and 12-o'clock positions, and a second portion providing a rail at/for the 6-o'clock position. It is advantageous that the rail of the 6-o'clock position be separately removable so as to permit grenade launcher installation (i.e., in lieu thereof, as each structure competes for the same physical space and generally uses the same attachment points on the weapon).

In addition to the aforementioned accessories (i.e., flashlights, scopes, aiming aids, etc.), vertical forend grips have become increasingly popular. In the rail system context, the forend grips are characterized by the well known female mounting flange which is slidingly or otherwise received upon a rail of the RAS, and thereafter selectively bound against a portion of the rail via, for example, a threaded fastener tightenable so as to engage or press against the rail and thereby secure the grip thereto (see e.g., U.S. Pat. Appl. Pub. No. US 2006/0277809 A1).

In a departure from the ubiquitous rail solution, RM Equipment, Inc. of Miami Fla. has developed a forend grip solution for the M203, including a rail mount variant thereof, as well as a forend grip solution for use in combination with an "unaltered" host weapon. As to the former, such M203 weapon grip assembly is characterized by, among other things, an actuatable affixation structure in the form of clamp or jaw segments which are adapted to receive a rib of a handguard of the M203 launcher. An exploded view of that assembly is provided as FIG. 1, a source thereof being Applicant's copending U.S. patent application Ser. No. 10/567,264 (i.e., published U.S. Pat. Appl. No. US 2007/0271832 A1), incorporated herein by reference in its entirety. With regard to the latter, such unaltered weapon grip assembly is characterized by, among other things, an actuatable affixation structure in the form of a bar or lug which cooperatively engages apertures of a conventional lower barrel handguard of a host weapon. A fragmentary side elevation of that assembly is provided as FIG. 2, the source thereof being Applicant's copending U.S. patent application Ser. No. 11/720,567, incorporated herein by reference in its entirety.

While there exist a plethora of known, advantageous, battle tested rail accessory devices, they obviously are limited to affixation to a rail. In as much as such existing, or even future rail accessory devices would serve grenadiers well, an attachment solution in a launcher barrel environment remains outstanding. Moreover, it remains advantageous to provide a modular accessory interface which would serve host weapons with or without an M203 launcher. More specific features and advantages obtained in view of those features will become apparent with reference to the drawing figures and the remainder of this document.

SUMMARY OF THE INVENTION

A rail accessory mounting apparatus is generally provided, more particularly, an apparatus readily mateable, securable, etc. to a weapon (or facsimile thereof), a subassembly thereof, etc. which provides a platform or further platform for the receipt of ubiquitous rail accessories. Broadly, the apparatus includes an actuatable affixation structure and a collar within which a portion of the affixation structure is receivable. Moreover, an actuator, progressively advanceable in relation to a base of the affixation structure so as to effectuate actuation of the affixation structure, is provided, and the apparatus further includes a rail accessory receiving rail supported at the collar, with the rail including a segment having a dovetail configuration characterized by a wedge shaped cross section with which a rail accessory device is readily mateable.

In one of several embodiments, the rail accessory mounting apparatus advantageously comprises actuatable jaw segments and a base from which the jaw segments extend, and a collar within which a portion of the base is seated, with the jaw segments operatively engageable with a portion of the collar in furtherance being drawn together upon actuation. An actuator, progressively advanceable in relation to the base so as to effectuate actuation of the jaw segments is provided, in addition to a rail accessory receiving fixture supported at or by the collar, the fixture comprising a segment having a dovetail configuration characterized by a wedge shaped cross section with which a rail accessory device is readily mateable.

As will be subsequently detailed, several variations are contemplated, and further possible, with regard to aspects of the instant rail accessory mounting apparatus. For example, and without limitation, the actuatable affixation structure may take the form of clamp or jaw segments, a bar, a lug, etc. In the context of a jaw or jaw segments, contemplated configurations include, but are not limited to, arcuate or profiled for union with a grenade launcher barrel, or a Picatinny rail or the like.

With regard to the rail accessory receiving structure, a variety of arrangements implicating same are available. Advantageously, but not necessarily, the rail accessory receiving structure is related to the collar, more particularly, the structure is supported at or by the collar, for example, so as to extend or otherwise depend therefrom.

With regard to actuation of the actuatable affixation structure, it is intended that field use/application of the instant apparatus be supremely quick, and effective. In furtherance thereof, a progressively advanceable actuator is provided, namely, an actuator progressively advanceable in relation to a base of the actuatable affixation structure. Indexed, locked indexed, and non-indexed actuation is contemplated, with "easy" operator manipulation desirable. In one embodiment, the rail accessory receiving fixture is configured, as is the actuator, to permit a 40 mm grenade casing to be utilized as a actuation aid.

DETAILED DESCRIPTION OF THE DRAWINGS

Figure 1:
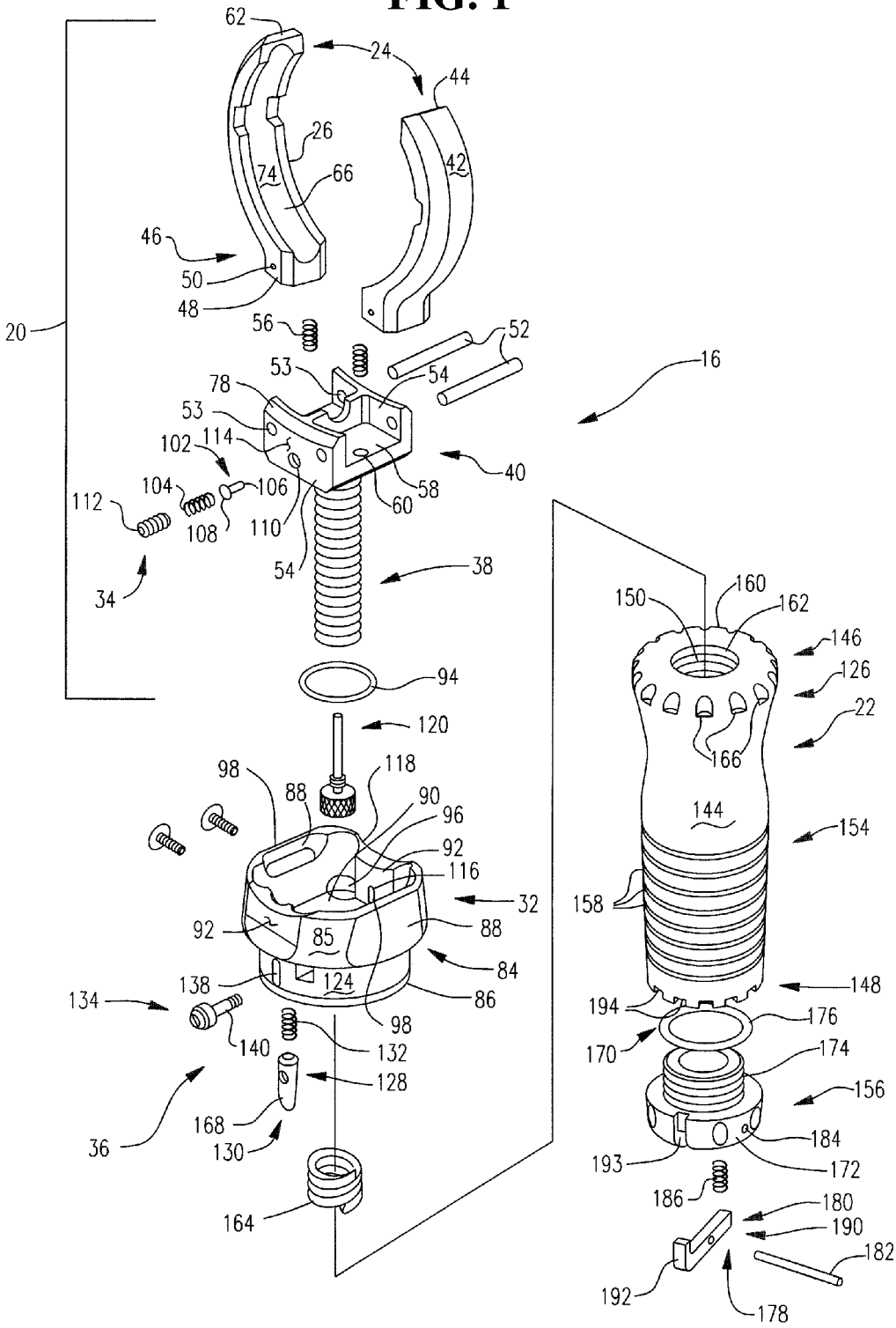
FIG. 1 depicts the particulars of a representative, non-limiting embodiment of Applicant's copending weapon grip assembly, namely, that disclosed in afore cited U.S. patent application Ser. No. 10/567,264.
Figure 2:
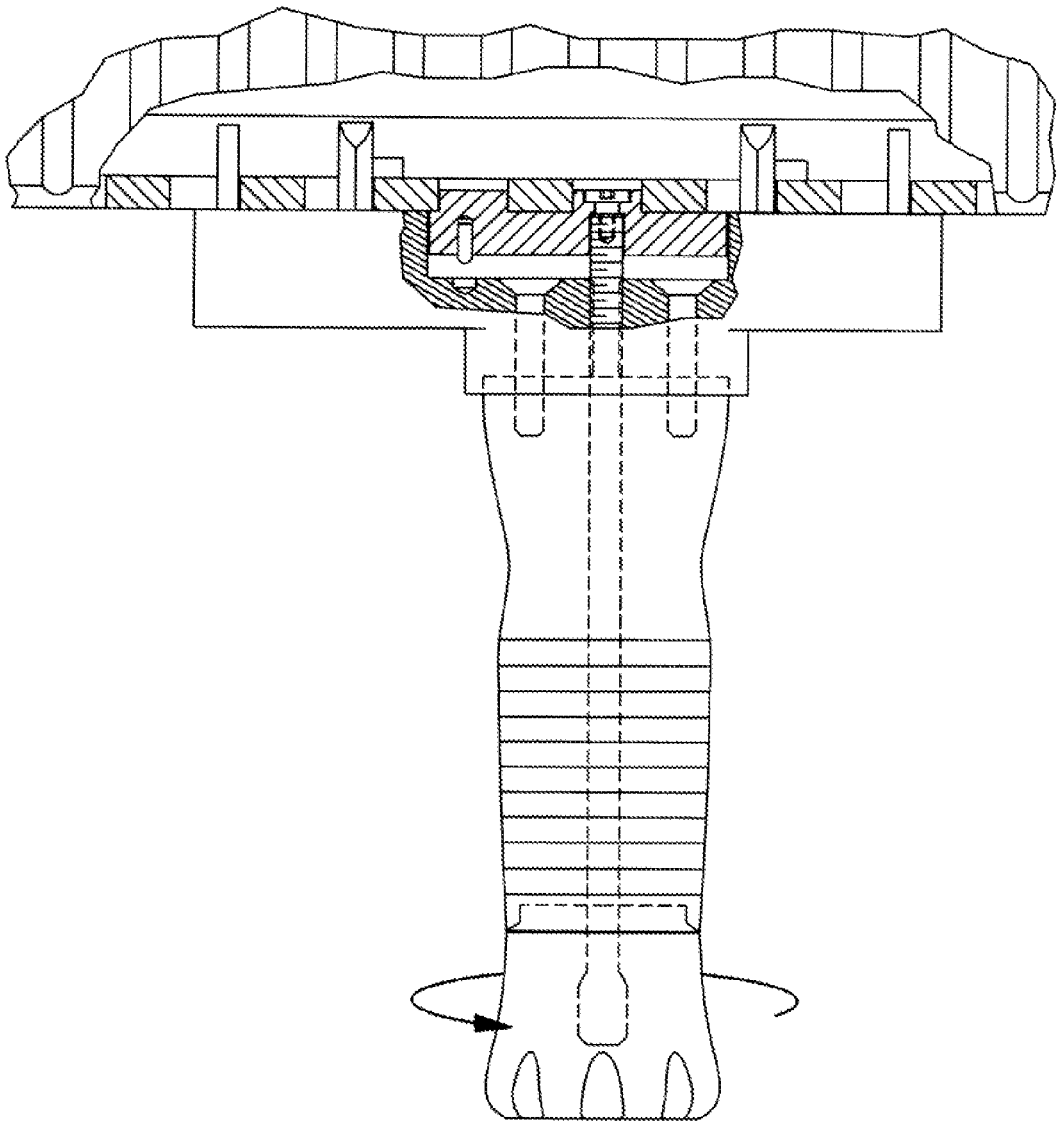
FIG. 2 depicts the particulars of a further representative, non-limiting embodiment of Applicant's copending weapon grip assembly, namely, that disclosed in afore cited U.S. patent application Ser. No. 11/720,567.

As a preliminary matter, in as much as reference has been or may have been previously made to one or both of FIGS. 1 & 2, including any of the illustrated structures thereof, particulars relating to one or both of these assemblies selectively follows in connection to a detailed description of the instant rail accessory mounting apparatus. Moreover, a preferred, non-limiting embodiment of the rail accessory mounting apparatus or adaptor is shown in the several views of FIGS.

Figure 6:
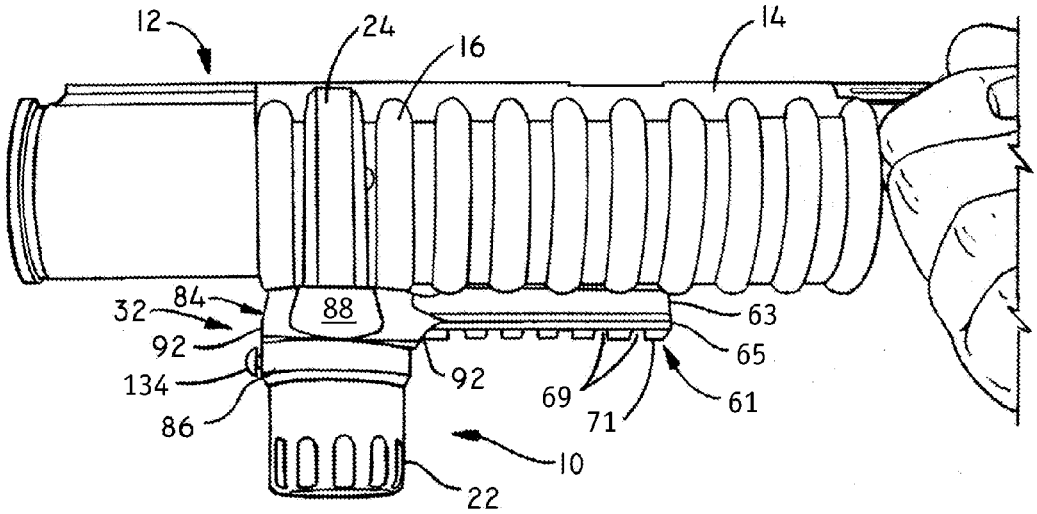
FIG. 6 depicts, in side elevation, the apparatus of FIG. 3 in operative combination with a barrel handguard of an M203 grenade launcher barrel, in readied condition for receipt of a rail accessory.
Figure 7:
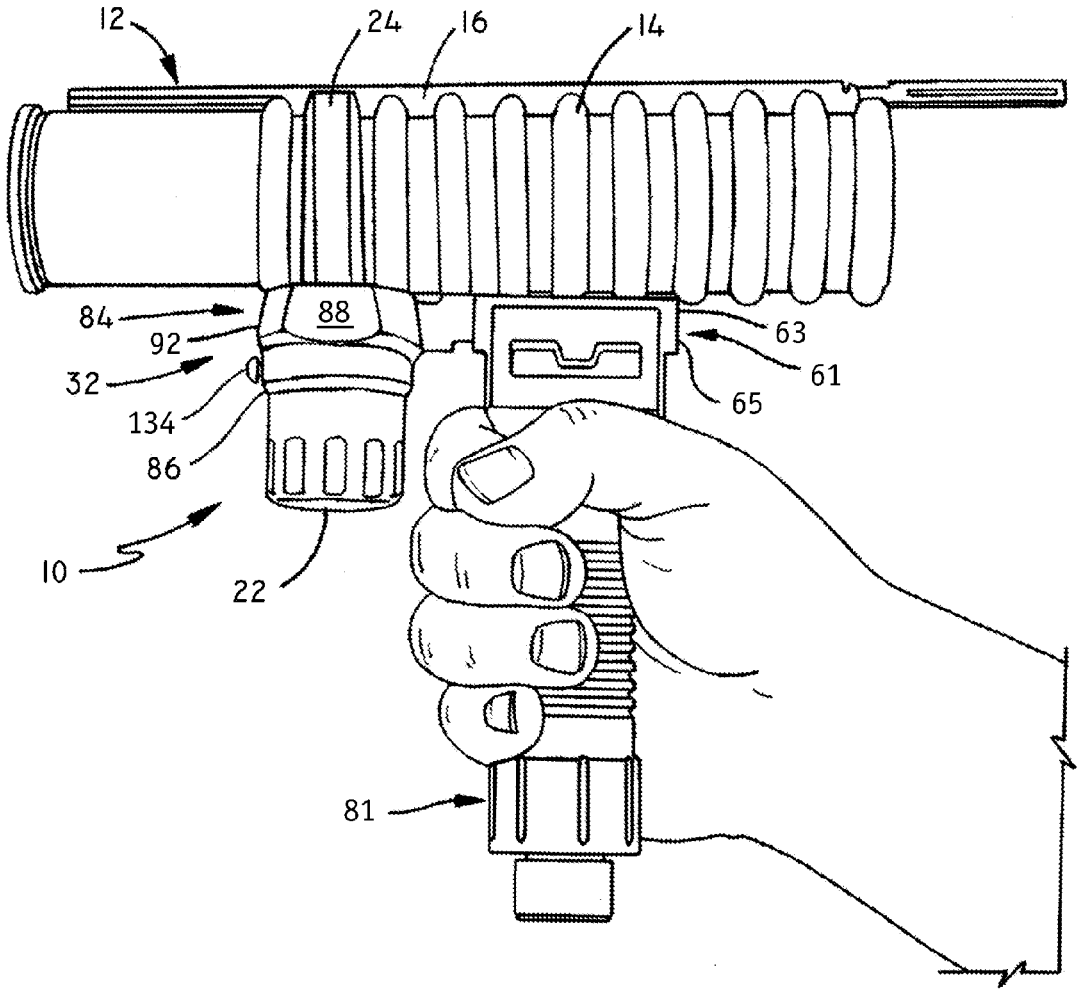
FIG. 7 depicts the combination of FIG. 6 wherein a rail accessory, namely, a Grip Pod® vertical forend grip, is shown operatively united with the rail accessory adaptor apparatus of the subject invention.
Figure 8:
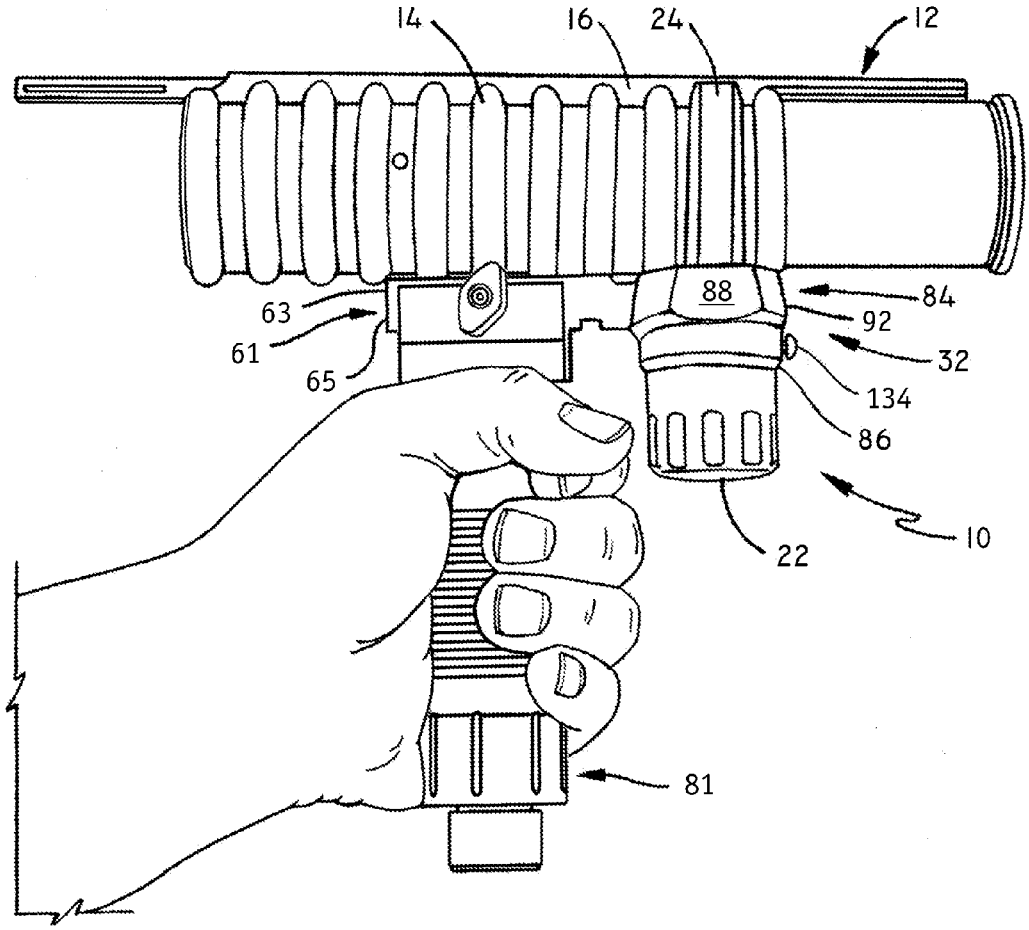
FIG. 8 depicts the combination of FIG. 7 from an opposite vantage point.

3-5, with select, preferred non-limiting particulars associated therewith shown in FIG. 1 or FIG. 2; is further shown in combination with a portion of an M203 40 mm grenade launcher in FIG. 6; and, is finally functional depicted in FIGS. 7 & 8 wherein the combination of FIG. 6 is shown in operative receipt of a rail accessory, namely, and again without intended limitation, a vertical forend grip with integral actuatable bi-pod.

Figure 3:
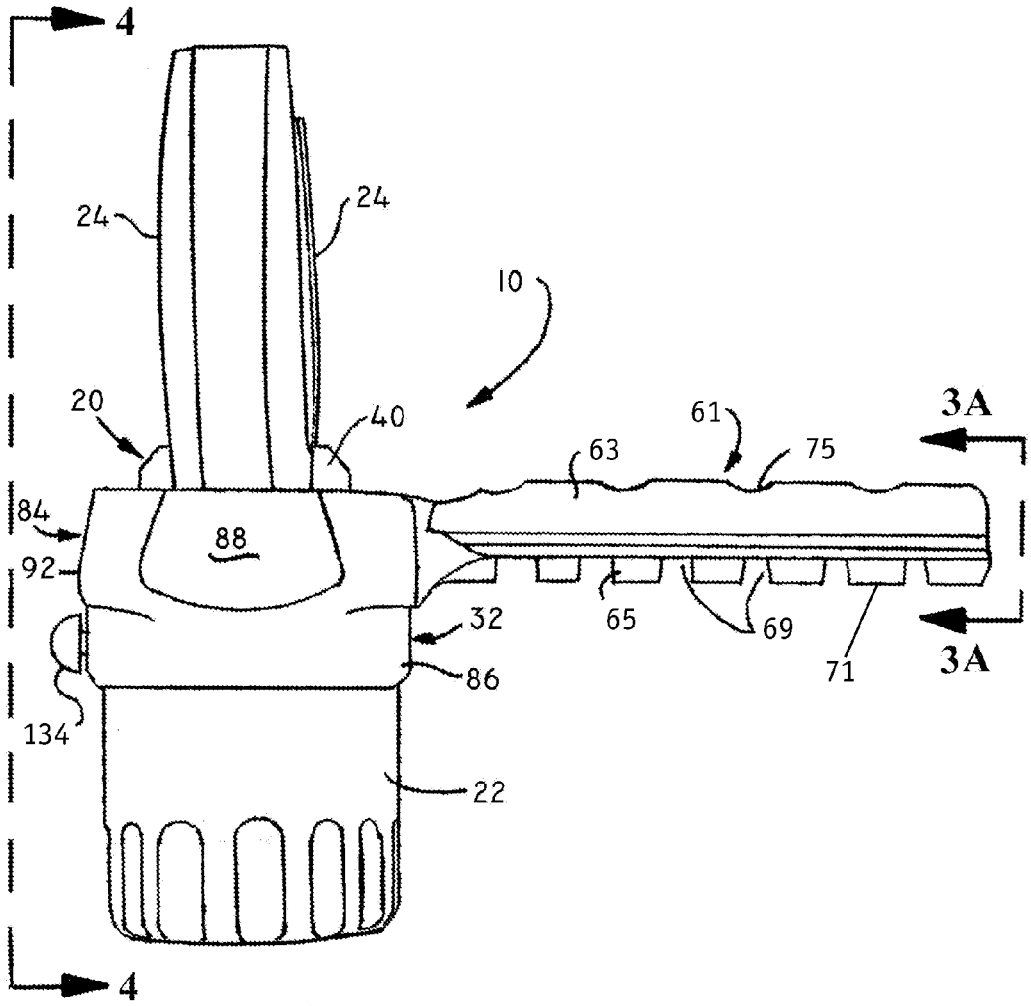
FIG. 3 depicts, in side elevation, a rail accessory adaptor apparatus of the subject invention.
Figure 4:
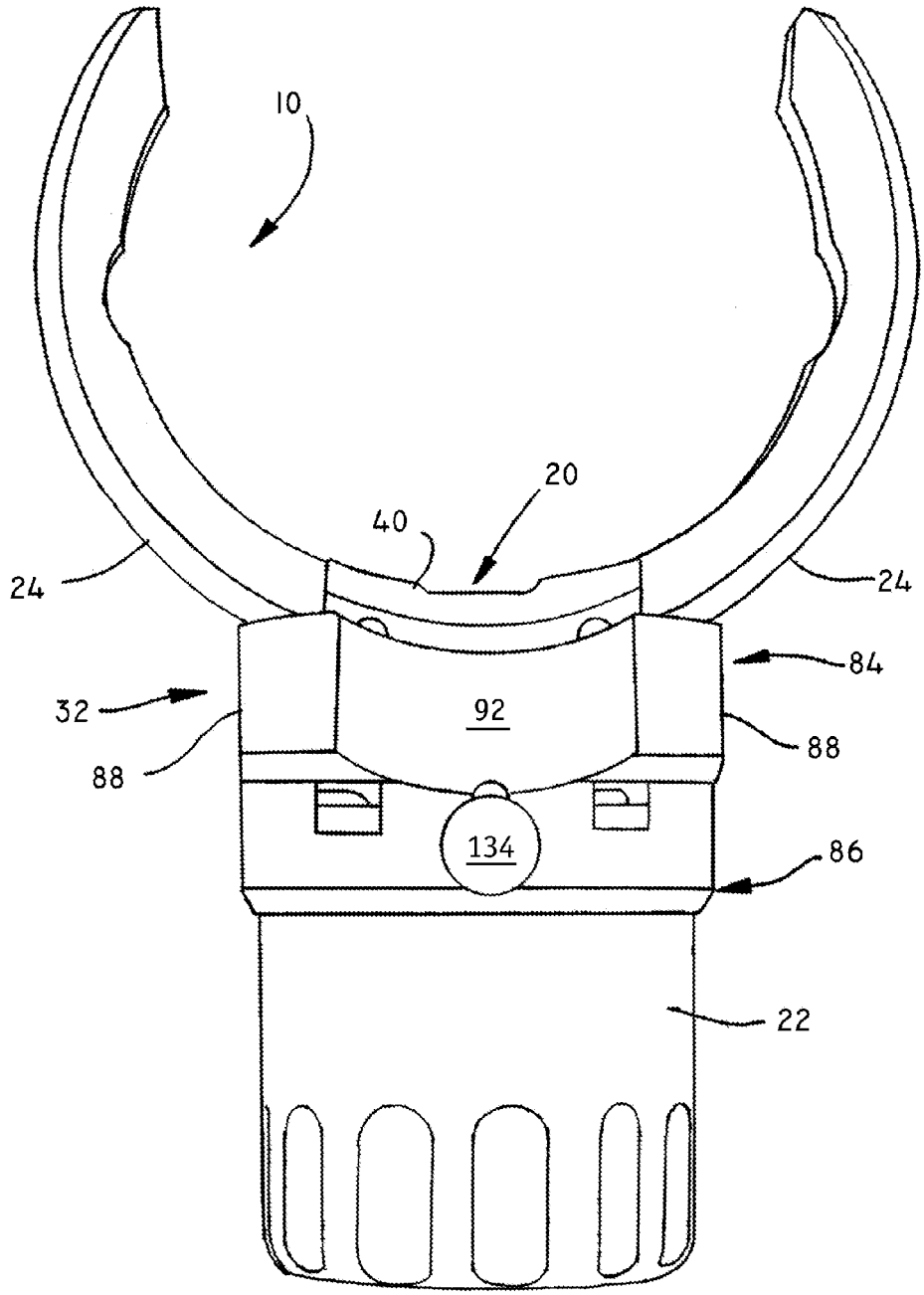
FIG. 4 is a view about line 4-4 of FIG. 3, namely, a front/rear elevation of the apparatus of FIG. 3.
Figure 5:
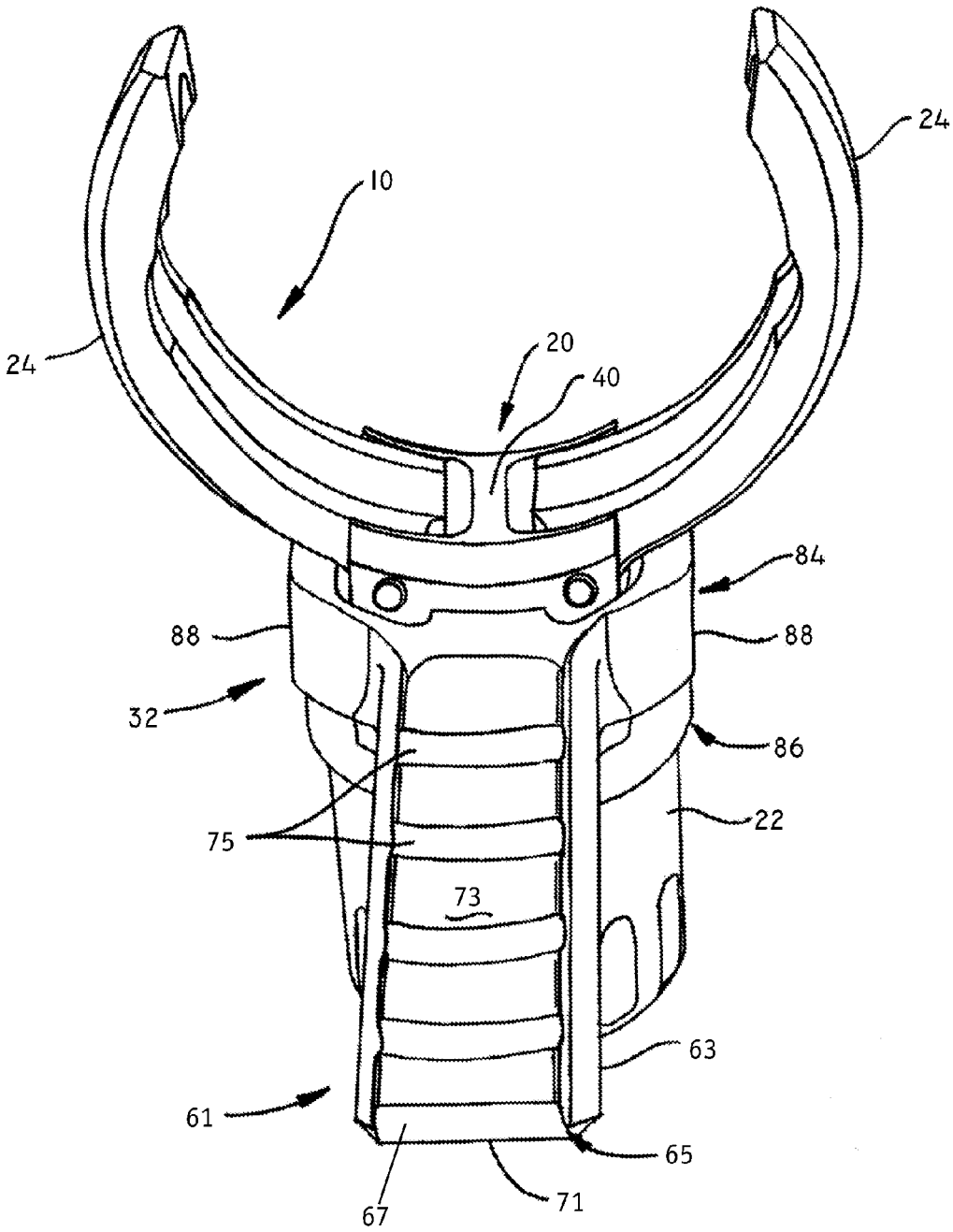
FIG. 5 is a view opposite of FIG. 4, and slightly from above.
Figure 9:
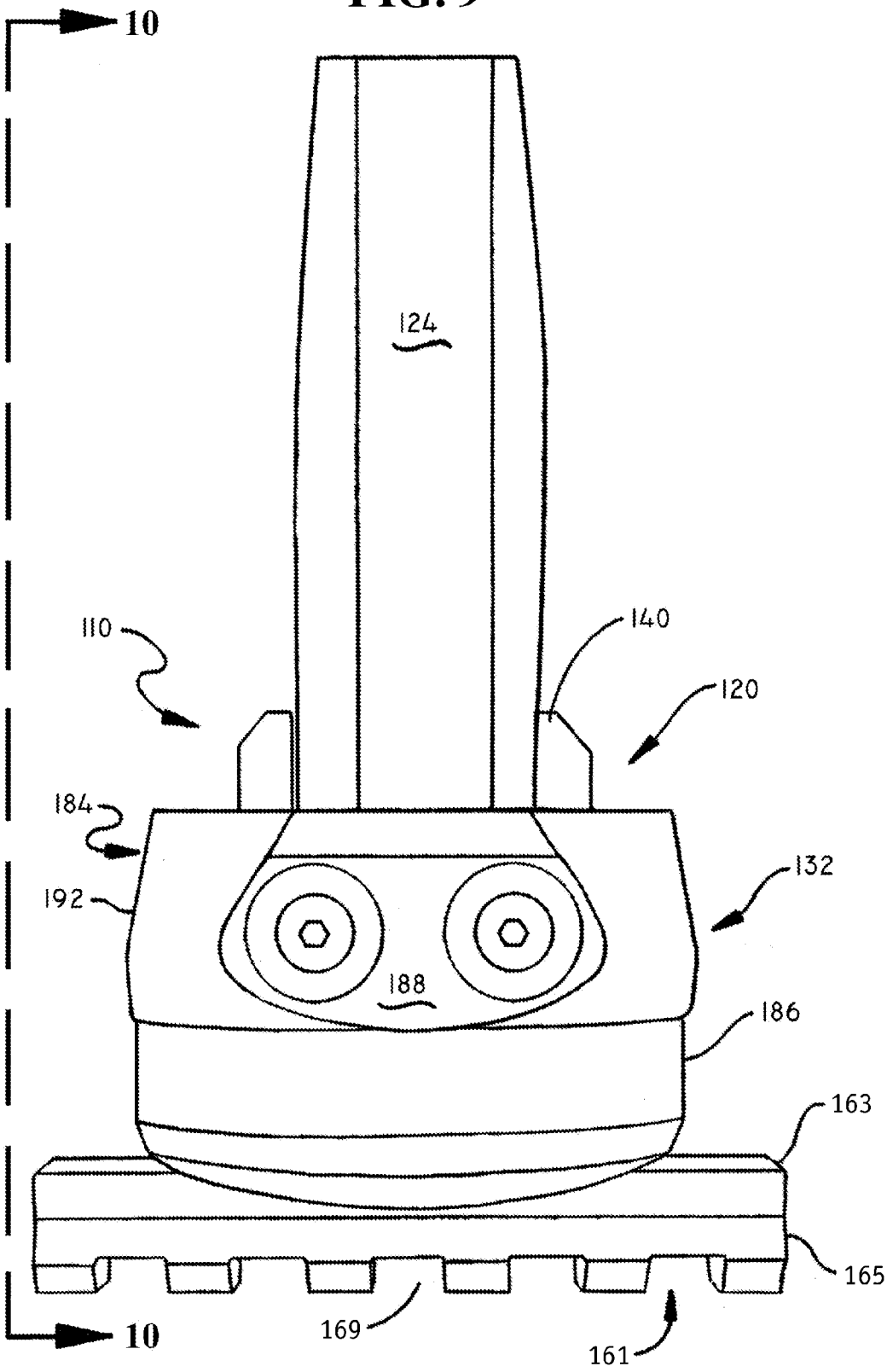
FIG. 9 depicts, in side elevation, an alternate embodiment of a rail accessory adaptor apparatus of the subject invention.
Figure 10:
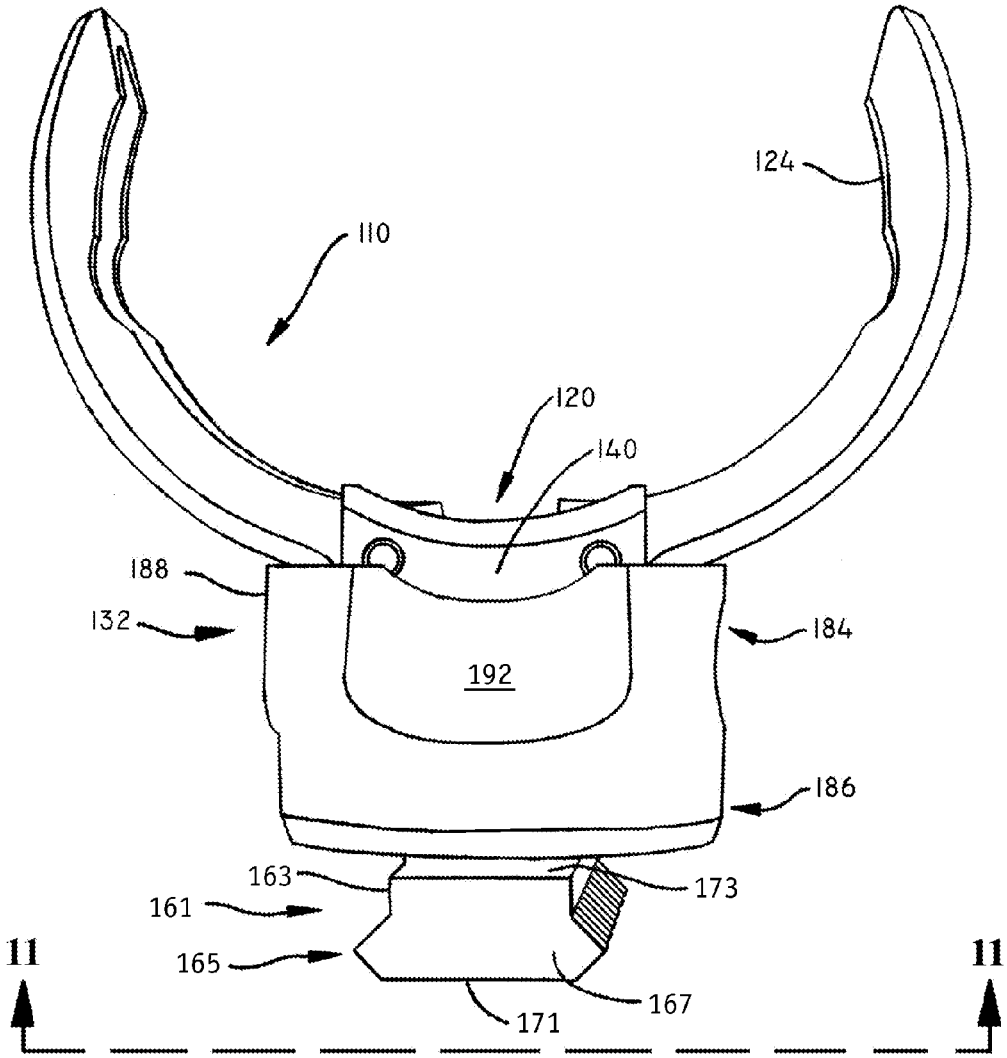
FIG. 10 is a view about line 10-10 of FIG. 9, namely, a front/rear elevation of the apparatus of FIG. 9.
Figure 11:
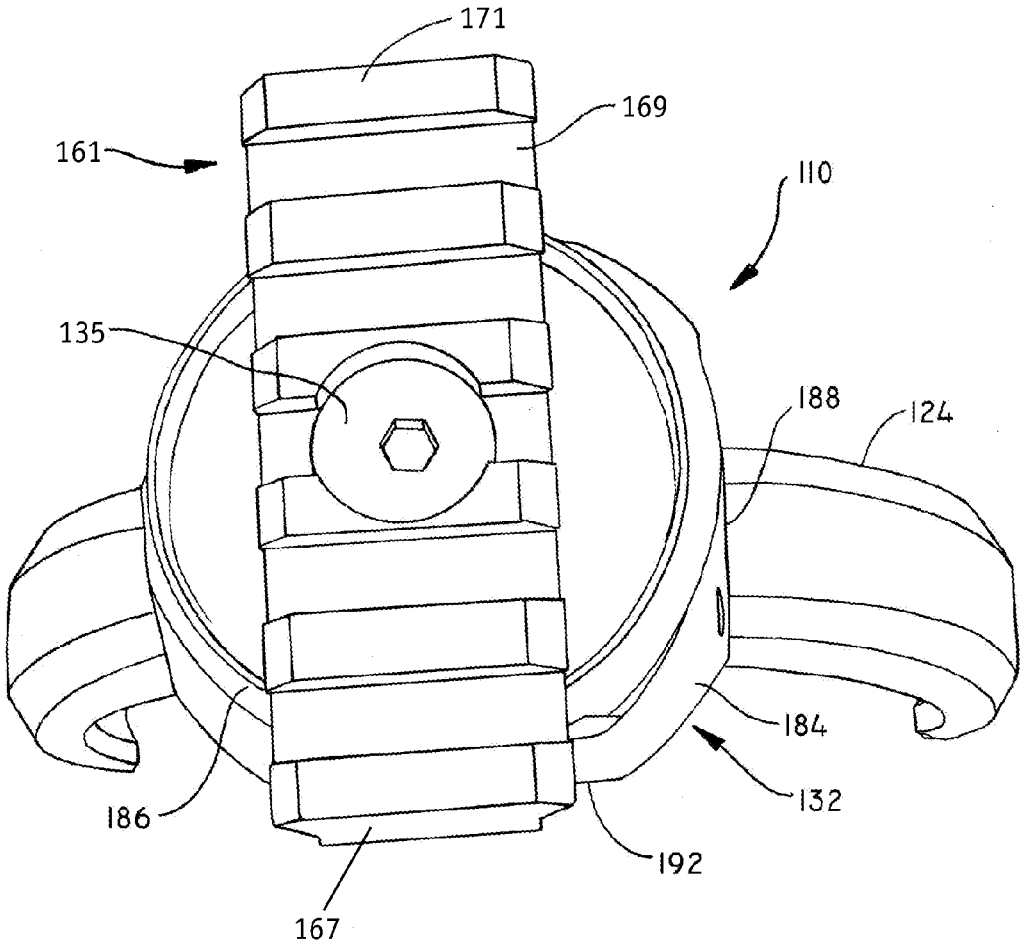
FIG. 11 is a view about line 11-11 of FIG. 10, namely, a plan view of the "underside" of the apparatus of FIG. 10.
Figure 12:
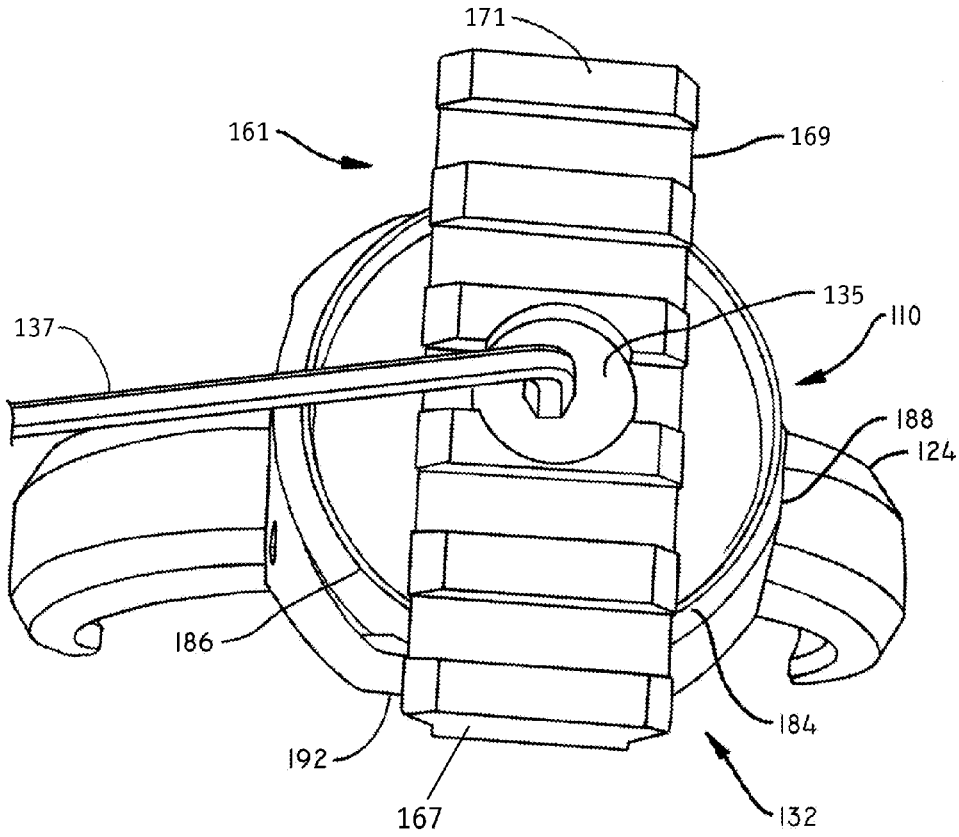
FIG. 12 is a view, as FIG. 11, depicting a tool in cooperative engagement with an actuator of the apparatus.
Figure 13:
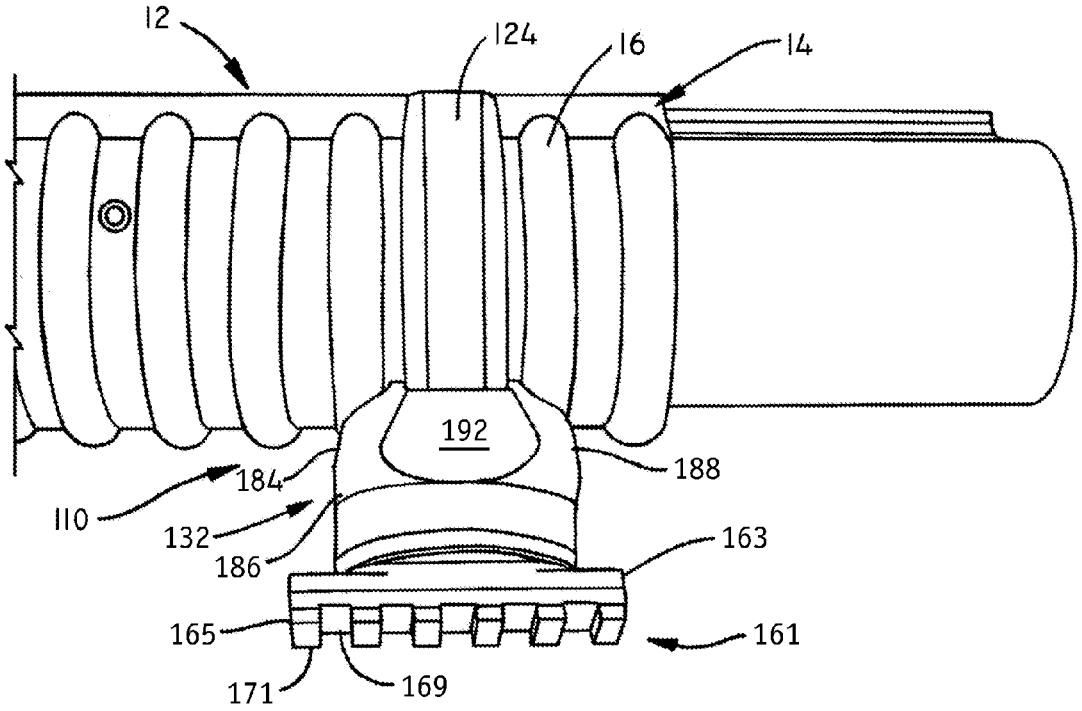
FIG. 13 depicts, in side elevation, the apparatus of FIG. 9 in operative combination with a barrel handguard of an M203 grenade launcher barrel, in readied condition for receipt of a rail accessory.
Figure 14:
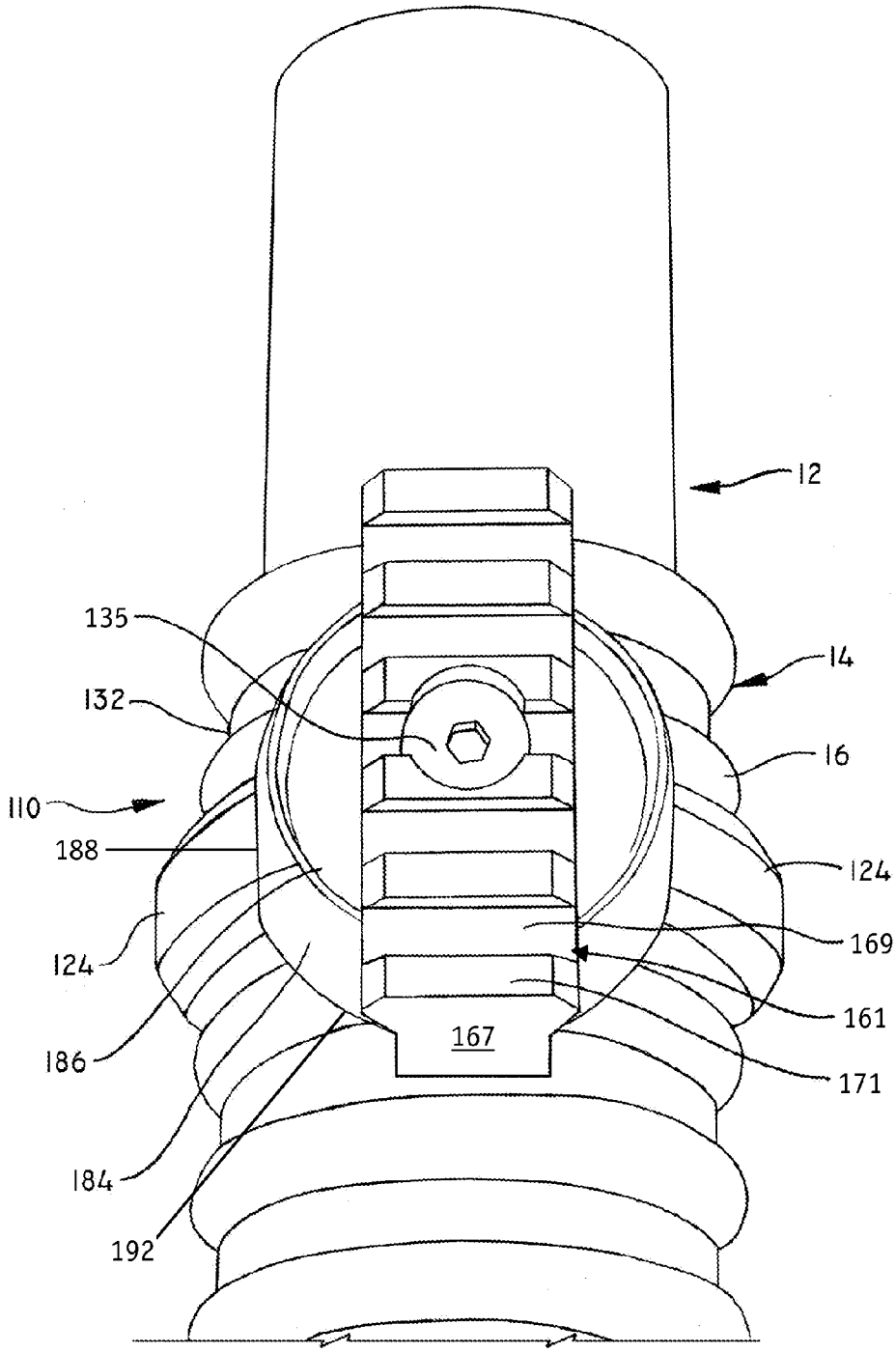
FIG. 14 is a "underside" view of the combination of FIG. 13.
Figure 15:
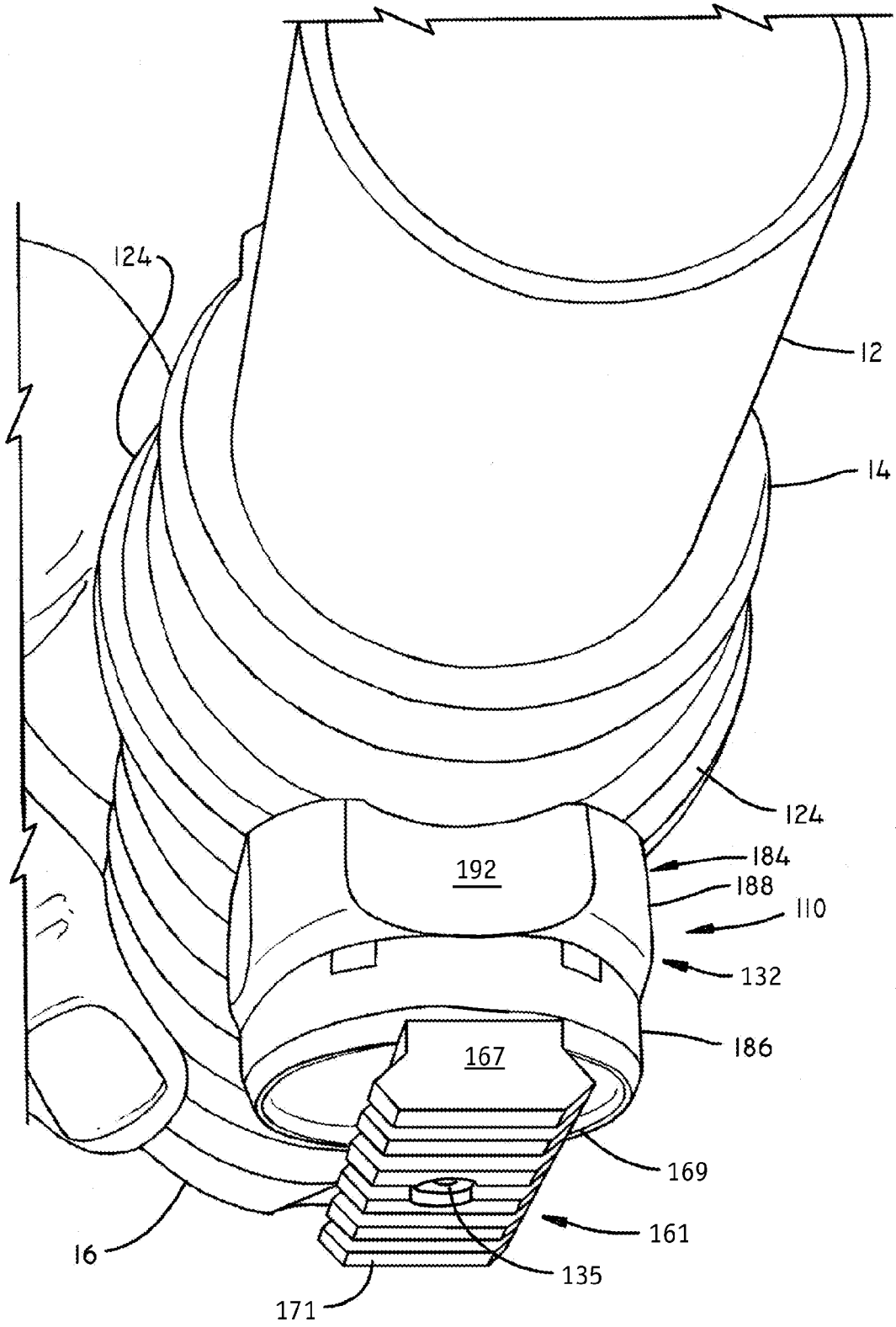
FIG. 15 an "end" view, from slightly below, of the combination of FIG. 13.

An alternate non-limiting embodiment of the rail accessory mounting apparatus or adaptor is further shown in the several views of FIGS. 9-11 wherein reference numerals +100 delimit like/similar structures in relation to the embodiment of FIGS. 3-5; is further shown being manipulated in furtherance of clamping/unclamping about a portion of an M203 40 mm grenade launcher in FIG. 12; and, is further shown in combination with a portion of such launcher in FIGS. 13-15. Finally, a further non-limiting embodiment of the rail accessory mounting apparatus or adaptor is further shown in the several views of FIGS. 16-18, wherein reference numerals +200 delimit like/similar structures in relation to the embodiment of FIGS. 3-5, and likewise shown in operative combination with a representative vertical forend grip in FIG. 19.

As should be readily apparent from a comparison/contrasting of FIGS. 3, 9, & 16, the latter embodiments of FIGS. 9 & 16 omit the "knob" of the former embodiment of FIG. 3 while nonetheless maintaining its associated "actuator" functionality as will be later detailed. Moreover, the latter embodiments provide an alternate relative placement/position for an interface bar/rail segment, more generally a rail accessory receiving rail or fixture, in relation to the other apparatus elements, i.e., alternate collar configurations or collar/rail accessory receiving fixture relationships are contemplated. Furthermore, as should be readily appreciated, in light of a review of the figures and subsequent description, a variety of alterations/modifications may be made to elements of the rail accessory mounting apparatus or adaptor, alterations or modifications which may be advantageous yet ancillary to the primary functionality of the device, namely, as an interface or linkage structure for essentially equipping an M203 grenade launcher with a rail accessory device, or for otherwise "adding" a base or platform for receipt of a rail accessory to a weapon, or weapon facsimile more generally.

With reference now to FIGS. 3-5, the rail accessory mounting apparatus 10 generally includes a base or base assembly 20 having portions extending from an actuator, more particularly, for example and as shown, a knob 22, and a mandrel or collar 32 interposed between a portion of the base assembly 20 and the knob 22 (FIGS. 3 & 5). The base assembly 20 of the rail accessory mounting apparatus 10 includes clamp or jaw segments 24, operatively linked to a clamp retainer 40 (see e.g., FIG. 1), adapted to be secured to a rib 16 of the handguard 14 of the launcher 12 (see e.g., FIG. 6), and a post 38 having a clamp end 40 adapted to retain the clamps 24 (see e.g., FIGS. 1 & 5). The clamps 24 are retained or anchored to the clamp end 40 of the post 38 for pivot motion with respect thereto, and are further preferably, but not necessarily individually biased so as to readily mate with/receive the launcher. Finally, and preferably as shown, but not necessarily, the apparatus 10 includes a latch or ratcheting system 36, characterized by among other things a latch actuator 134 extending from lower portion 86 of collar 32, wherein rotation of knob/handle 22, via operative engagement with both the collar 32 and the post 38 of the base assembly 20 effectuates an indexed closure of clamp segments 24. The description of the foregoing elements, their interrelationships, and their functions are thoroughly described in Applicant's copending patent applications, more particularly, U.S. patent application Ser. Nos. 10/567,564 and 12/277,045, each of which are incorporated herein in their entireties.

Figure 3A:
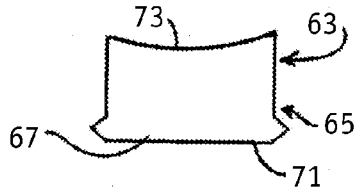
FIG. 3A is a view about line 3A-3A of FIG. 3.

With particular reference now to FIGS. 3, 5 & 6, an advantageous structural departure from Applicant's collar of the previously cited applications is shown. The subject collar 32 includes a rail accessory receiving rail or fixture, more particularly, as illustrated, an interface extension (i.e., bar) 61, colloquially a "tail," possessing a characteristic Picatinny configuration, namely, the MIL-STD-1913 mounting rail profile comprising a grooved dovetail, namely, a configuration characterized by a wedge shaped cross section (FIG. 3A). The interface bar 61 integrally or otherwise extends from collar 32, more particularly as shown, from a upper portion 84 thereof, and more particularly still, from a "secondary" sidewall of a pair of secondary sidewalls 92, which, in association with opposingly paired "primary" sidewalls 88, delimit the upper portion 84 thereof. Although not specifically illustrated, it should be appreciated that adaptation of the device of FIG. 2, or equivalents thereof, are readily had so as to include the described adaptor functionality viz-a-viz the interface extension as described and shown herein, including any variants and/or equivalents thereof.

The interface bar 61 generally includes segments, for example, "upper" 63 and "lower" 65 longitudinal segments or portions (FIGS. 3 & 3A). The lower portion 65 includes the Picatinny dovetail/wedge 67 for receipt of a cooperative or mating portion of a rail accessory, as well as recoil grooves 69 on lower surface 71 of the bar 61 (FIG. 3). The upper portion 63 of the interface bar 61 is characterized by an upper surface 73 adapted to receive a segment of the handguard of the M203 launcher. More particularly, the upper bar surface 72, is generally concave (FIG. 3A), and advantageously includes launcher rib recoil grooves 75 for receipt of one or more, generally at least a pair, of launcher handguard ribs (see/compare FIGS. 3 & 6). As should be readily appreciated, the length dimension of the interface bar is generally selective, with spatial constraints primarily dictated by the length of handguard available for engagement.

As detailed in Applicant's cited '264 copending application, the accessory mounting apparatus of FIG. 3, with clamp segments biased or otherwise in an "open" configuration (e.g., FIG. 4), is positioned in relation to the launcher, more particularly the launcher handguard, such that a select rib is seated or otherwise received upon an upper surface of the clamp end of the base assembly (see FIGS. 1 & 5). Thereafter, the knob (i.e., the actuator), which may readily configured as a hand hold/forend grip (FIG. 1), is rotated in a clockwise direction so as to draw the threaded post of the base assembly into a bore of the knob (FIG. 1) in furtherance of securing the clamp segments about the launcher (FIG. 6), i.e., the clamp segments are drawn together upon actuation. Moreover, such action creates an interference fit between the clamp end of the post and the launcher handguard via seating of the upper edges of each of the upstanding wall segments of the clamp end (FIG. 1) against handguard portions adjacent the select rib (FIGS. 6-8). Further still, such action registers and seats the rib recoil grooves of the upper portion of the interface bar with the ribs of the handguard as shown (FIG. 6). With the combination of FIG. 6, any commercially available rail accessory device may be supported upon a weapon system comprising an M203 launcher.

By way of illustration, with no limitation intended, a popular vertical forend grip with bi-pod 81 is shown in FIGS. 7 & 8 affixed to the combination of FIG. 6. The accessory, the details of which are provided for in U.S. Pat. Appl. Publ. No. US 2006/0277809 A1, is understood to provide an advantageous dual functionality, namely, a forward vertical weapon support grip, and weapon stability viz-a-vis a deployable bi-pod, to the extent the weapon system incorporates a Picatinny rail.

With reference now to the embodiment of FIGS. 9-11, rail accessory mounting apparatus 110 generally includes an alternately configured base or base assembly 120, a mandrel or collar 132 which surrounds or houses a portion of the base, namely clamp end 140 thereof, an rail accessory receiving fixture, for example, interface bar 161 as shown which depends from the collar 132, and an actuator, for example, a fastener, namely, a hex head bolt 135 as shown (FIG. 11) which operatively links, unites or synchs the collar with/to the base. Generally, the instant base or base assembly 120 "omits" the post structure 38 of base assembly 20 of apparatus 10 (FIGS. 3-5; see also FIG. 1). In lieu thereof, clamp end 140 of base assembly 120 includes a threaded or otherwise adapted bore hole (not shown) for receipt of a free end of the fastener 135. Rather than rotate the knob 22 of apparatus 20 to effectuate an operative engagement thereof about a rib of the launcher handguard (i.e., have the knob/collar combination "ride-up" the stud or post 38 so that the collar 32 operatively contacts/engages clamp segments 24, an actuation (i.e., rotation) aid, in this case a hand tool 137 (FIG. 12) is used to rotate hex head bolt 135 or the like to effectuate an operative engagement of apparatus 120 about a rib of the launcher handguard (i.e., have the base assembly/collar combination "ride-down" the bolt so that the collar is in operative contact with the clamp segments).

The base assembly 120 of the weapon grip assembly 110 includes clamp or jaw segments 124 adapted to be secured to a rib 16 of the handguard 14 of the launcher 12, and clamp base or clamp end 140, for operative retention of the clamp segments (FIGS. 1 & 10). The clamps 124 are advantageously retained or anchored to base 140 for pivot motion with respect thereto, and are further preferably, but not necessarily individually biased so as to readily mate with/receive the launcher. The description of the foregoing elements, more particularly, the clamp segments 124, as well as the structure (s) operatively supporting them, and the collar, including their interrelationships and their functions, are readily appreciated with reference to FIG. 1 and Applicant's previously cited '264 copending application.

The collar 132 of apparatus 120 of the subject invention is advantageously positioned to operatively engage/contact the clamp segments 124 in furtherance of their clamping about a rib of the handguard of the launcher. The collar 132 preferably has upper 184 and lower 186 portions, the upper portion receiving a portion of the base assembly therein (FIGS. 9 & 10), the lower portion 186 having interface bar 160 depending therefrom. In as much as the interface bar of the figures appears separable or separate from the collar, advantageously, but not necessarily, an adaptation of the illustrated collar to incorporate such element is contemplated, e.g., a collar having an integral interface bar, more particularly, a collar having a lower portion adapted to incorporate an interface bar or the configuration of that structure as shown and described. Moreover, without the knob/stud combination of the embodiment of FIGS. 3-5, vestiges of the ratcheting/indexing system advantageous and well suited for that embodiment are not/may not be warranted in the contemplated preferred and/or commercial embodiments relating to or having origins in the apparatus of FIGS. 9-11.

Structurally, the upper portion 184 of the collar 132 includes at least one set of opposingly paired side walls 188, again "primary" side walls for the sake of the discussion, between which extends a "floor" (not visible, but see FIG. 1), i.e., the side walls 188 upwardly extend from the floor. Preferably, but not necessarily, the upper portion 184 of the mandrel 132 includes a further set of opposingly paired side walls, e.g., "secondary" side walls 192. The floor, which includes a thru hole or aperture for receipt of fastener 134, in combination with the side walls 188, 192, effectively "house," and more particularly seat a portion of the base or clamp retaining structure/element 140 of the base assembly 120.

Each of the primary side walls 188 of the upper portion 184 of the mandrel 132 preferably include a profiled (e.g., beveled) top edge (not visible, but see FIG. 1) which defines a point of contact (i.e., a contact line or surface) for and/or between the mandrel 132, namely the upper portion 184 thereof, and each of the clamps 124. As may be readily appreciated based upon the disclosure to this point, the clamps 124 of the base assembly 120 pivotingly respond to axial positioning of the mandrel 132 owing to progressive receipt of the fastener 134 into the bore hole of the base 126.

The interface bar 161 includes a segment having a dovetail configuration characterized by a wedge shaped cross section, more particularly as shown, a "lower" longitudinal portion 165 (FIGS. 9 & 10) includes the Picatinny dovetail (i.e., wedge section 167) for receipt of a cooperative or mating portion of a rail accessory. Moreover, recoil grooves 169 are included on or as part of the lower surface 171 of the fixture (e.g., FIG. 9 or 11). As should be readily appreciated, the length dimension of the interface bar is generally selective, with spatial constraints primarily dictated by the length of handguard available for engagement. Relative to apparatus 20 of FIGS. 3-5, interface bar 161 "omits" the adapted "upper" longitudinal portion 73 thereof.

With reference now to FIGS. 13-15, apparatus 110 is shown in operative engagement with the launcher, more particularly, operatively received upon a rib of the handguard thereof. As should be readily appreciated with reference to FIG. 13, advantageously, but not necessarily, the collar of apparatus 110 may be adapted, at least to some extent, so as to provide a more compact configuration for the apparatus.

Figure 16:
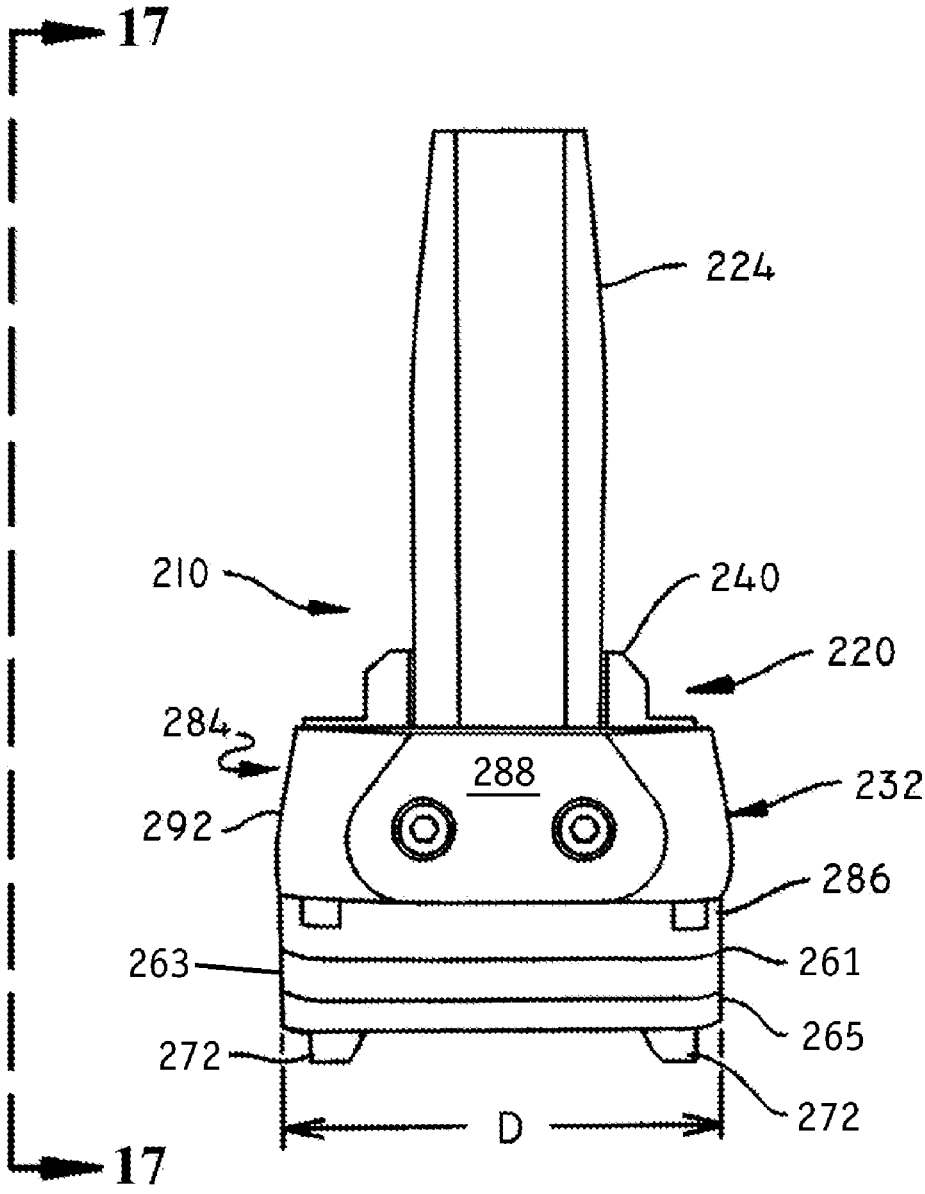
FIG. 16 depicts, in side elevation, yet a further embodiment of a rail accessory adaptor apparatus of the subject invention.
Figure 17:
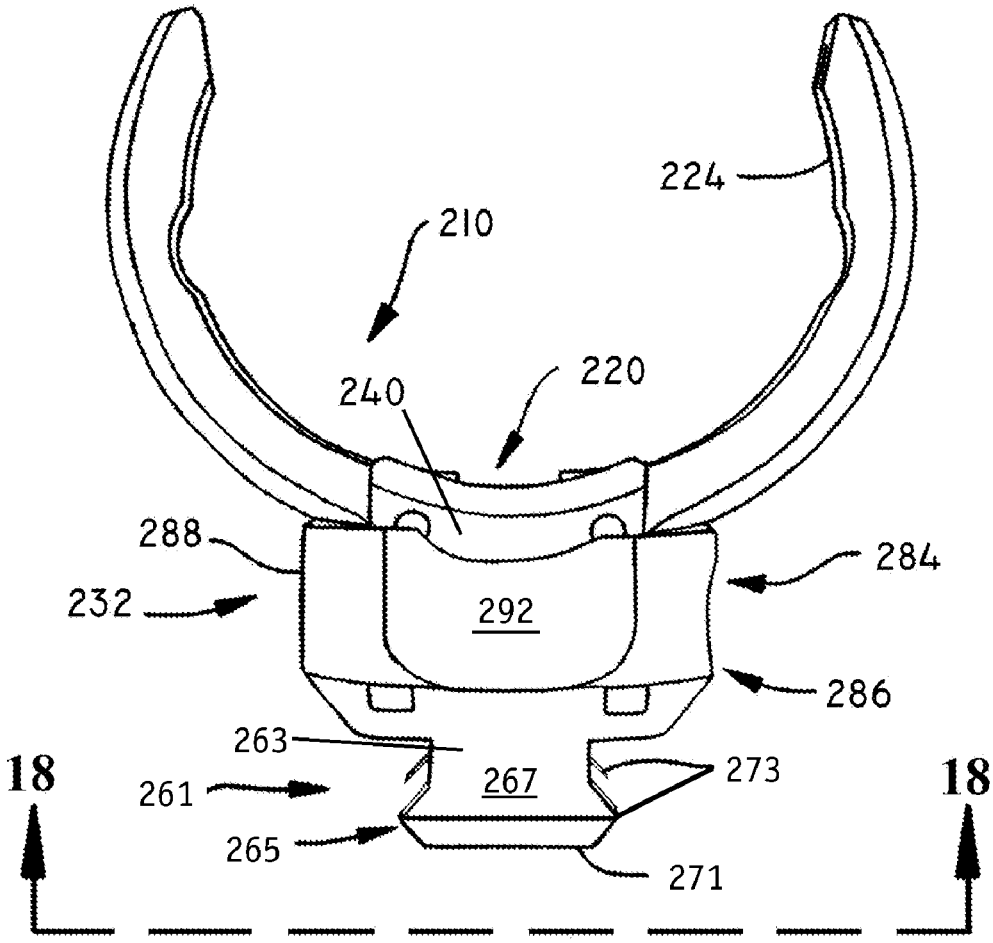
FIG. 17 is a view about line 17-17 of FIG. 16, namely, a front/rear elevation of the apparatus of FIG. 16.
Figure 18:
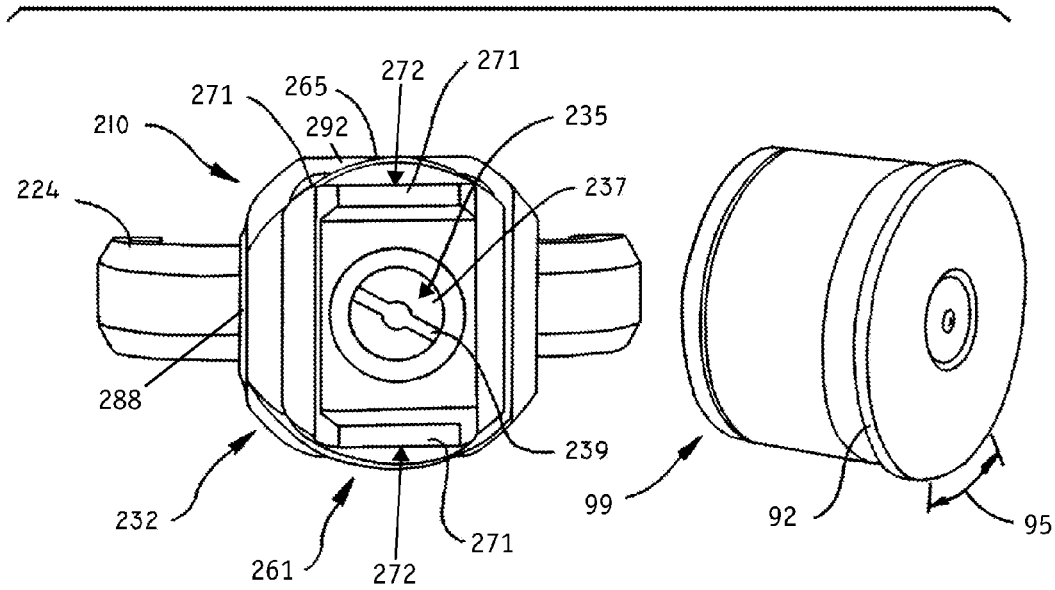
FIG. 18 is a view about line 18-18 of FIG. 17, namely, a plan view of the "underside" thereof, a 40 mm cartridge case depicted therewith; and, FIG. 19 depicts the apparatus of FIG. 16 in operative combination with the vertical forend grip of FIG. 7.
Figure 19:
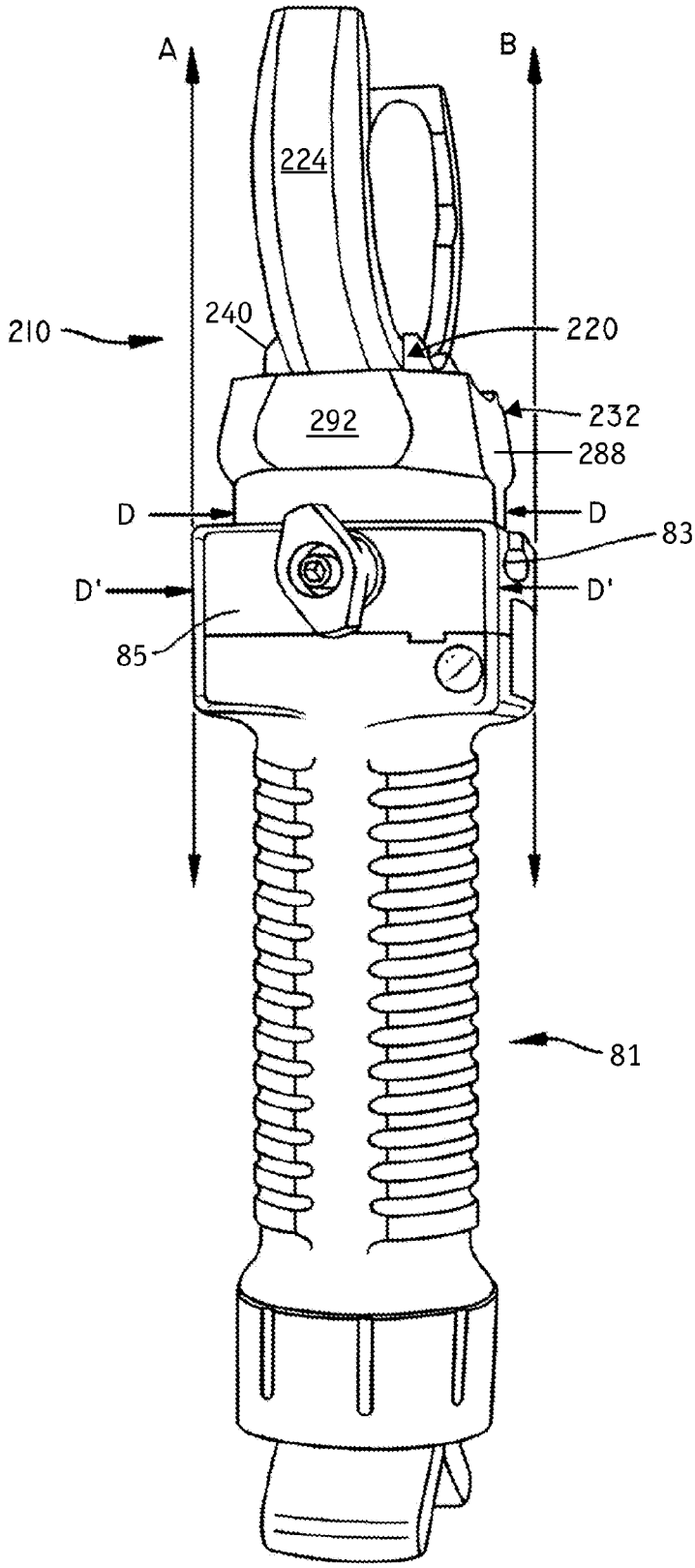

With reference now to the embodiment of FIGS. 16-18, and the combination of FIG. 19, rail accessory mounting apparatus 210 generally comprises actuatable jaw segments 224 and a base assembly 220 from which the jaw segments generally extend, a collar 232 within which base portion 240 is seated (not entirely visible, but see FIG. 1), a rail receiving rail in the form of an interface bar 261 supported at or by the collar 232, and an actuator, progressively advanceable in relation to the base so as to effectuate actuation of the jaw segments, for example, as shown, a fastener 235 having head 237 adapted for ready receipt of one or more fastening aids as will later be described in connection to FIG. 18. Generally, as the embodiment of FIGS. 9-11, the subject base assembly 220 omits the post 38 of base assembly 20 of apparatus 10 (FIGS. 3-5). In lieu thereof, base portion 240 of base assembly 220 includes a threaded or otherwise adapted bore hole (not shown) for receipt of a free end of the fastener 235.

The base assembly 220 of the weapon grip assembly 210 includes clamp or jaw segments 224 adapted to be secured to a rib 16 of the handguard 14 of the launcher 12 (e.g., FIG. 17 or 19), and base 240 for operative retention of the clamp segments 224 (FIG. 17). The elements of this apparatus embodiment, including their relationships or interrelationships, are readily appreciated with reference to the prior description of the embodiments, related figures, as well as the explicit and/or implicit discussion/disclosure in connection to FIG. 1 and/or FIG. 2 as the case may be.

In a departure from the embodiment of FIGS. 9-11, the subject apparatus embodiment is configured for integration with a launcher without a need for a special or dedicated tool.

As should be readily appreciated with reference to FIG. 18, fastener head 237 is adapted so as to advantageously include a slot 239 dimensioned to receive a segment 95 of a base (i.e., rim 97) of a grenade cartridge 99. As shown, the subject adaptation of the actuator may readily stand alone, or be an addition to, or in addition to the recess of the fastener head 237 of FIG. 11 as illustrated.

With particular reference to FIGS. 16 & 17, interface bar 261 is advantageously but not necessarily integrally formed so as to extend from mandrel 232, more particularly, upper portion 263 of the interface bar 261 appears as an extension of lower portion 286 of collar 232 as best seen with reference to FIG. 17. The interface bar 261 includes a "lower" 265 longitudinal portion (FIGS. 16 & 17), more particularly, a Picatinny dovetail or wedge section 267 for receipt of a cooperative or mating portion of a rail accessory. In lieu of the plural recoil grooves 69 of bar 61 (FIG. 3), or grooves 169 of bar 161 (FIG. 9), the lower surface 271 of bar 261 has a cut-out/material removed (FIGS. 16 & 18) such that a segment of the grenade cartridge may be matingly united with the fastener head in furtherance of reversible affixation of the apparatus to a grenade launcher (i.e., the configuration of the lower surface of the bar enables fastener head access by a driving aid in the form of the cartridge base).

With reference now to FIG. 19, the apparatus of FIG. 16 is shown supporting, via a mating interface, the vertical forend grip of FIGS. 7 & 8, namely, a G.P.S. Grip Pod Systems® grip 81. Opposing ends 272 of lower surface 271, namely, the structures delimiting the cut-out thereof, are matingly received, fore and aft, by structures of a rail receiving fixture 83 of grip 81, accessible via manipulation of a sidewall 85 thereof. Once so received, sidewall 85 is urged into engagement with the remaining elements of rail receiving fixture 83 and about the lower longitudinal portion 265 of the bar 261. As should be appreciated with reference to FIGS. 16 & 19, advantageously, but not necessarily, the rail accessory adaptor apparatus resides within an area bounded by planes A & B as indicated which correspond to fore and aft surfaces of the rail receiving fixture as shown (i.e., apparatus length dimension D (FIG. 16) is less than fixture length dimension D' (FIG. 19).

Via the rail accessory mounting apparatus so disclosed and adapted readily or otherwise, such accessorization advantage is for the first time available to grenadiers. More particularly, via the present rail accessory mounting apparatus, a host weapon characterized by an M203 launcher may be readily, and securely equipped with present, and future rail accessories. Moreover, via the particulars of the instant disclosure, further rail mounting "real-estate" is readily achieved in circumstances wherein an actuatable affixation structure is intended for receipt upon/engagement with a weapon or weapon system not equipped with a non-launcher, for example and without limitation, a weapon handguard via its apertures, or a rail of a weapon or weapon system.

That which is claimed:

1. An apparatus for equipping a grenade launcher with a rail system accessory, the apparatus comprising:

a. an affixation structure characterized by jaw segments and a base from which said jaw segments extend;

b. a collar having upper and lower collar portions, said base of said affixation structure residing within said upper collar portion;

c. an interface bar for receipt of a rail system accessory, said interface bar comprising opposing end portions, each opposing end portion of said opposing end portions having a Picatinny dovetail sectional profile, said interface bar depending from said lower collar portion of said collar so as to extend therebelow; and, d. an actuator for securing said jaw segments about the grenade launcher, a portion of said actuator passing through said interface bar and said collar for receipt and advancement with respect to said base of said affixation structure.

2. Apparatus for securing a rail system accessory to a grenade launcher, the apparatus comprising:

a. a clamp assembly characterized by clamp segments and a clamp assembly base, said clamp segments pivotably extending from said clamp assembly base;

b. a collar characterized by upper and lower portions, said upper portion receiving said clamp assembly base, said lower portion characterized by a rail accessory receiving platform and an aperture therethrough; and, c. an actuator upwardly extending through said aperture of said rail accessory receiving platform for operative engagement with said clamp assembly base, actuation of said actuator drawing said clamp assembly into said upper portion of said collar.

3. The apparatus of claim 2 wherein said rail accessory receiving platform includes a lower surface characterized by a plurality of recoil grooves.

4. The apparatus of claim 2 wherein said rail accessory receiving platform includes a lower surface characterized by an absence of recoil grooves.

5. The apparatus of claim 2 wherein said rail accessory receiving platform includes a lower surface characterized by a plurality of a Picatinny dovetail sections.

6. The apparatus of claim 2 wherein said rail accessory receiving platform includes a lower surface characterized by a pair of a Picatinny dovetail sections.

7. The apparatus of claim 2 wherein said rail accessory receiving platform is dimensioned so as not to exceed a fore/aft dimension of said collar.

8. The apparatus of claim 1 wherein said actuator comprises a faster.

9. The apparatus of claim 1 wherein said actuator comprises a faster having a head adapted for receipt of a tool in furtherance of manipulating said fastener.

10. The apparatus of claim 1 wherein said actuator comprises a faster having a head characterized by a recess for receipt of a tool in furtherance of manipulating said fastener.

11. The apparatus of claim 1 wherein said actuator comprises a faster having a slotted head for receipt of a tool in furtherance of manipulating said fastener.

12. The apparatus of claim 1 wherein said interface bar is dimensioned so as not to exceed a fore/aft dimension of said collar.

13. The apparatus of claim 1 wherein said jaw segments pivotably extend from said base.

14. The apparatus of claim 1 wherein said jaw segments biasingly extend from said base.

15. The apparatus of claim 1 wherein each jaw segment of said jaw segments is adapted to receive a rib of a handguard of the grenade launcher.

16. The apparatus of claim 1 wherein said interface bar is integral to said collar.

17. The apparatus of claim 1 in operative combination with a rail system accessory, said rail system accessory matingly received upon said interface bar.

18. The apparatus of claim 1 in operative combination with a grenade launcher, said jaw segments in operative union with a portion of said grenade launcher.

19. The apparatus of claim 1 in operative combination with a rail system accessory, said rail system accessory matingly received upon said interface bar, and in further operative combination with a grenade launcher, said jaw segments in operative union with a portion of said grenade launcher.

20. The apparatus of claim 2 wherein said actuator comprises a faster.

21. The apparatus of claim 2 wherein said actuator comprises a faster having a head adapted for receipt of a tool in furtherance of manipulating said fastener.

22. The apparatus of claim 2 wherein said actuator comprises a faster having a head characterized by a recess for receipt of a tool in furtherance of manipulating said fastener.

23. The apparatus of claim 2 wherein said actuator comprises a faster having a slotted head for receipt of a tool in furtherance of manipulating said fastener.

24. The apparatus of claim 2 wherein said clamp segments pivotably extend from said clamp assembly base.

25. The apparatus of claim 2 wherein said clamp segments biasingly extend from said clamp assembly base.

26. The apparatus of claim 2 wherein each clamp segment of said clamp segments is adapted to receive a rib of a handguard of the grenade launcher.

27. The apparatus of claim 2 wherein said rail accessory receiving platform is integral to said collar.

28. The apparatus of claim 2 in operative combination with a rail system accessory, said rail system accessory matingly received upon said rail accessory receiving platform.

29. The apparatus of claim 2 in operative combination with a grenade launcher, said clamp segments in operative union with a portion of said grenade launcher.

30. The apparatus of claim 2 in operative combination with a rail system accessory, said rail system accessory matingly received upon said rail accessory receiving platform, and in further operative combination with a grenade launcher, said clamp segments in operative union with a portion of said grenade launcher.

* * * * *